US006273045B1

(12) United States Patent
Pierce

(10) Patent No.: US 6,273,045 B1
(45) Date of Patent: Aug. 14, 2001

(54) VALVE SPRING RETAINER-ENLARGED SLOTS

(76) Inventor: Daniel H. Pierce, 1330 Lyonhurst, Birmingham, MI (US) 48009

( * ) Notice: Subject to any disclaimer, the term of this patent is extended or adjusted under 35 U.S.C. 154(b) by 0 days.

(21) Appl. No.: 09/360,932

(22) Filed: Jul. 26, 1999

(51) Int. Cl.[7] ..... F01L 3/10

(52) U.S. Cl. ..... 123/90.67; 123/90.65; 251/337

(58) Field of Search ..... 123/90.65, 90.66, 123/90.67, 188.12, 188.13, 188.17; 251/337; 29/215, 249

(56) References Cited

U.S. PATENT DOCUMENTS

| | | | | |
|---|---|---|---|---|
| 2,855,915 | * | 10/1958 | Norton | 123/90.67 |
| 4,201,162 | * | 5/1980 | Speckhart | 123/90.67 |
| 4,665,869 | * | 5/1987 | Hinz et al. | 123/90.67 |
| 4,829,952 | * | 5/1989 | Barker | 123/90.67 |
| 4,838,218 | * | 6/1989 | Sato et al. | 123/90.67 |
| 5,275,376 | * | 1/1994 | Rich | 251/337 |
| 5,343,835 | * | 9/1994 | Rhodes | 123/90.67 |
| 5,381,765 | * | 1/1995 | Rhodes | 123/90.67 |
| 5,619,961 | * | 4/1997 | Diggs | 123/188.13 |
| 5,873,563 | * | 2/1999 | Hoving, III | 251/337 |

* cited by examiner

*Primary Examiner*—Teresa Walberg
*Assistant Examiner*—Fadi H. Dahbour
(74) *Attorney, Agent, or Firm*—Howard & Howard

(57) ABSTRACT

A valve spring retainer (30) for operatively retaining a return spring (28) on a stem (20) of a poppet valve in an internal combustion engine. The retainer (30) includes a retainer flange (50) extending annularly about and radially from a hole (52) on a central axis A to an outer periphery for engaging the top of a spring (28). A ring (56) is disposed below the flange (50) and extends about the axis A for surrounding the valve stem (20). An inner portion (58) extends cylindrically about the axis A and axially between the ring (56) and the flange (50). A plurality of slots (61) extend radially from the hole (52) to the periphery and divide the flange (50) and the inner portion (58) into sectors (S) leaving the ring (56) to interconnect the sectors (S). The retainer (30) is characterized by the slots (61) being formed to extend radially at a wide width x and with each of the sectors (S) including a limit projection (63) at the periphery to define a narrow width (Y). More specifically, the retainer (30) is formed in an open position and collapses inwardly to an operating position.

8 Claims, 6 Drawing Sheets

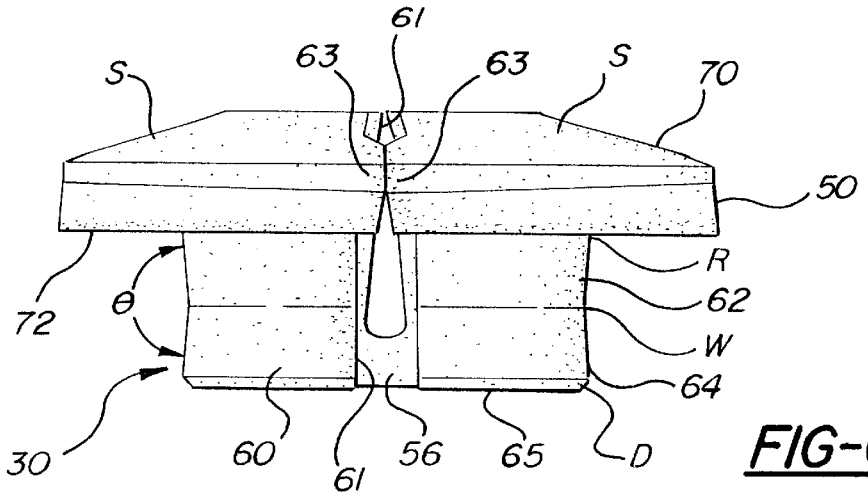
FIG-6
FIG-7
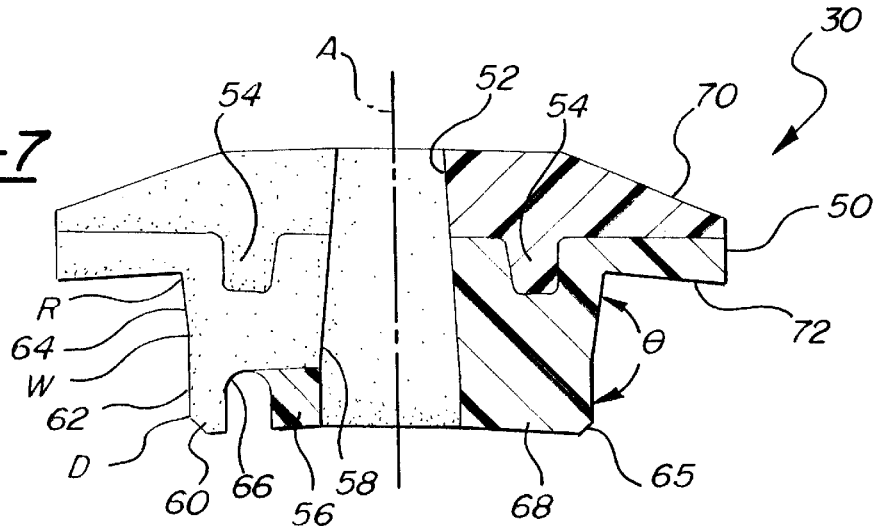
FIG-8
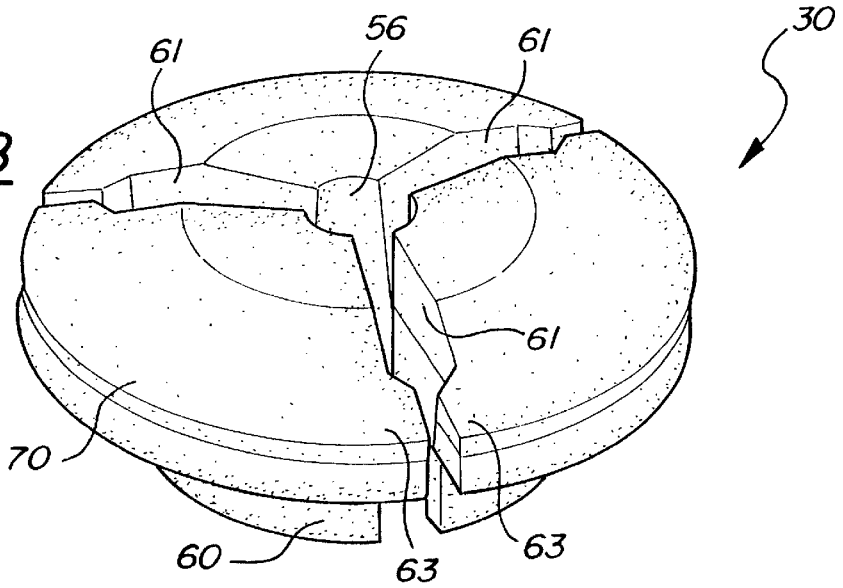

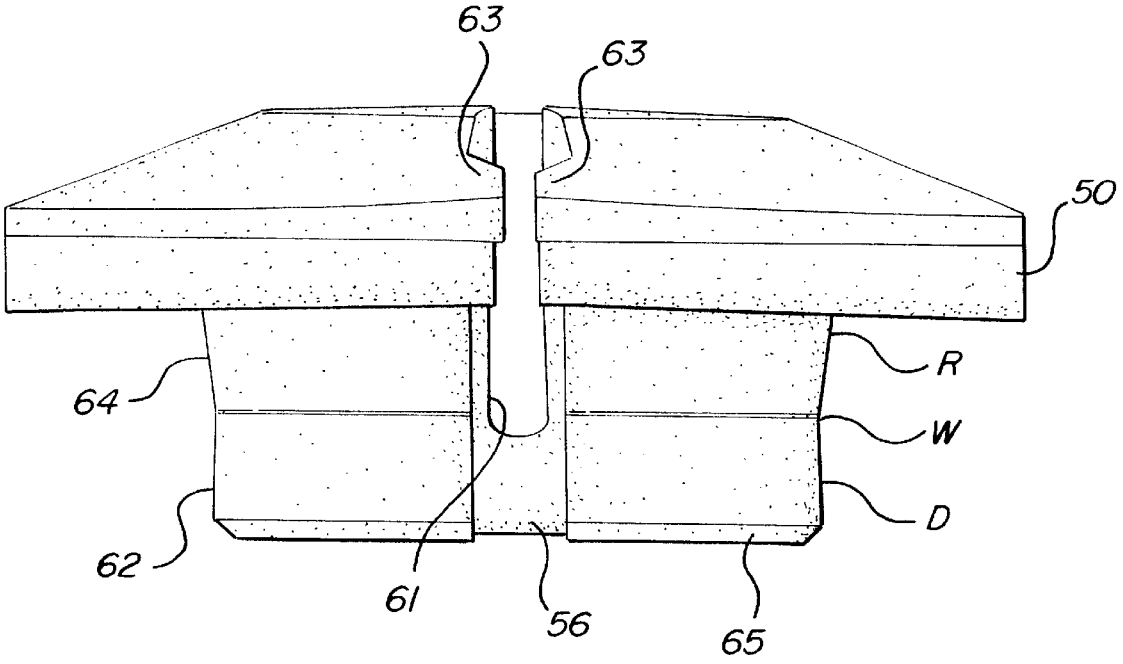
FIG-11
FIG-12
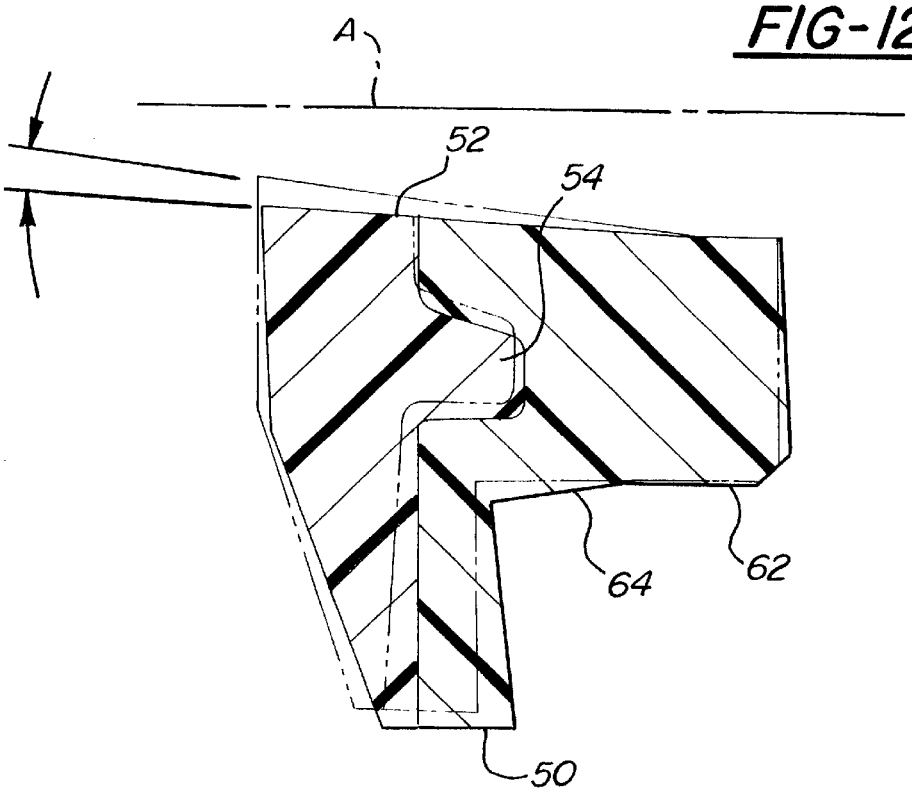

VALVE SPRING RETAINER-ENLARGED SLOTS

BACKGROUND OF THE INVENTION

1. Field of the Invention

The subject invention relates to a valve spring retainer for operatively retaining a return spring on the stem of a poppet valve in an internal combustion engine.

2. Description of the Prior Art

The use of valve spring retainers in internal combustion engines is well known. Self locking retainers are known wherein the retainer automatically locks on the valve stem as the retainer is pressed onto the valve stem by reaction with the spring during operation. Such a retainer typically includes a retainer flange extending annularly about a hole on a central axis for engaging the top of a spring. A ring is disposed below the flange and extends about the axis for surrounding a valve stem. An inner portion extends cylindrically about the axis and axially between the ring and the flange. A skirt portion is spaced radially from and extends cylindrically about the inner portion and depends axially from a root diameter adjacent the flange to a distal end diameter. A plurality of slots extend radially from the hole and divide the flange and the portions into sectors leaving the ring to interconnect the sectors. During operation the spring reacts against a retainer flange and urges the sectors to rotate into engagement with the stem to lock onto the stem. The spring is centered by the skirt. Such assemblies are shown in U.S. Pat. No. 5,293,848 to Rich et al and applicant's previous U.S. Pat. No. 4,879,978; 5,143,351; 5,226,229; and 5,255,640.

The slots dividing the retainer into sectors must be narrow to prevent the sectors from rotating excessively relative to one another because the sectors must react against one another in the circumferential direction to force the hole into locking engagement with the valve stem. Yet, it is difficult to fabricate a retainer with narrow slots due to the complexities of molding.

SUMMARY OF THE INVENTION AND ADVANTAGES

The subject invention provides an improved valve spring retainer for operatively retaining a return spring on a stem of a poppet valve in an internal combustion engine. The retainer includes a retainer flange extending annularly about and radially from a hole on a central axis to an outer periphery for engaging the top of a spring. A ring is disposed below the flange and extends about the axis for surrounding a valve stem. An inner portion extends cylindrically about the axis and axially between the ring and the flange. A plurality of slots extend radially from the hole to the periphery and divide the flange and the inner portion into sectors leaving the ring to interconnect the sectors. The retainer is characterized by the slots extending radially at a wide width and each of the sectors including a limit projection at the periphery to define a narrow width whereby the limit projections limit relative annular rotation between the sectors.

The invention also provides a method of fabricating such a retainer which is characterized by forming a limit projection at the periphery of each of the sectors to define a narrow width which is more narrow than the wide width.

Accordingly, the subject invention provides a retainer and method of fabricating same wherein the retainer is fabricated in an open position with wide slots to accommodate the molding process yet provides the requisite limiting of relative rotation between the retainer sectors during operation.

BRIEF DESCRIPTION OF THE DRAWINGS

Other advantages of the present invention will be readily appreciated as the same becomes better understood by reference to the following detailed description when considered in connection with the accompanying drawings wherein:

FIG. 6 is a side view of the retainer of FIG. 2;

FIG. 7 is a cross sectional view taken along line 7—7 of FIG. 4;

FIG. 8 is a perspective view of the retainer of FIG. 2 but in the molded or open position;

FIG. 11 is a side view of the retainer in the position illustrated in FIG. 8; and FIG. 12 is a fragmentary cross sectional view of the retainer shown illustrating the open forming position in full lines and the operating position in phantom lines.

DETAILED DESCRIPTION OF THE PREFERRED EMBODIMENT

Figure 1:
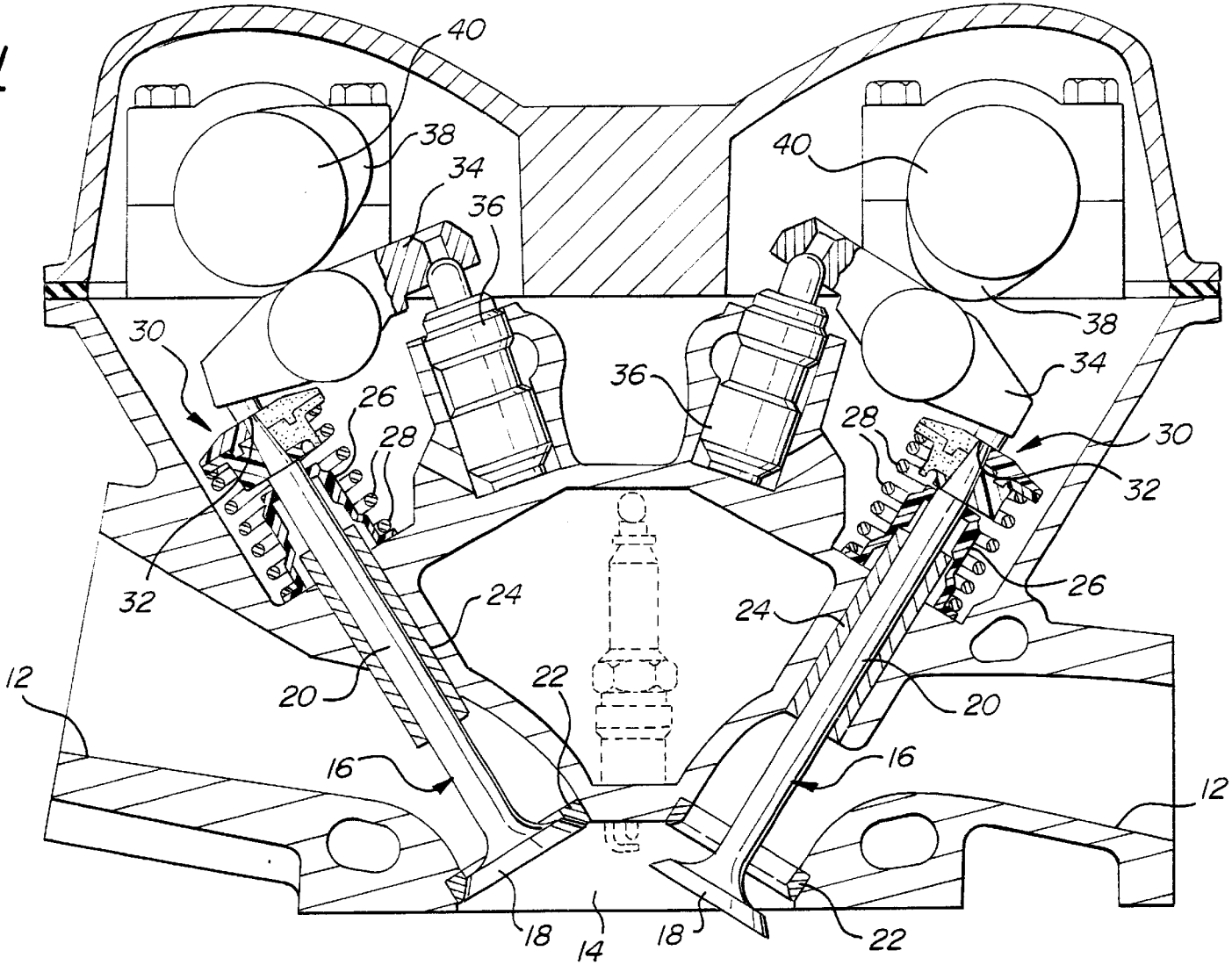
FIG. 1 is a cross sectional view showing a retainer incorporating the subject invention installed in an internal combustion engine.
Figure 2:
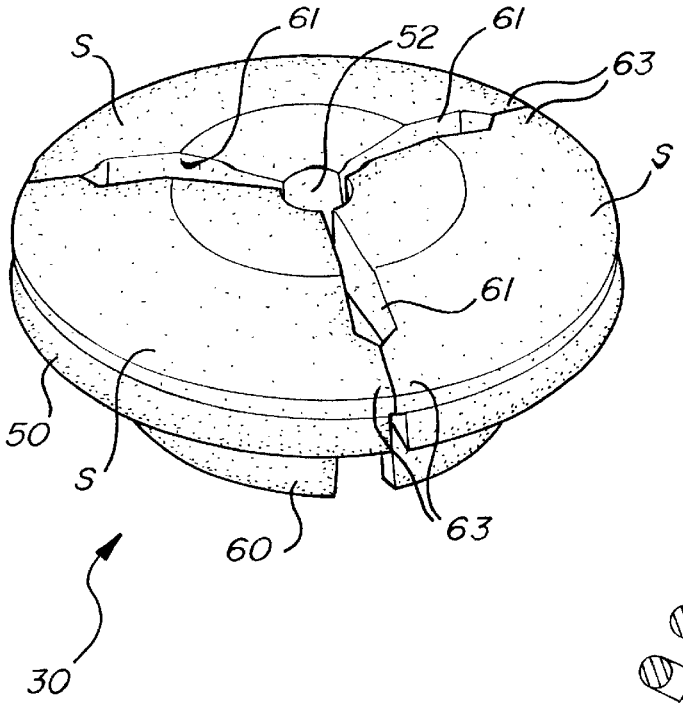
FIG. 2 is a perspective view of a retainer incorporating the subject invention in the operating position.
Figure 3:
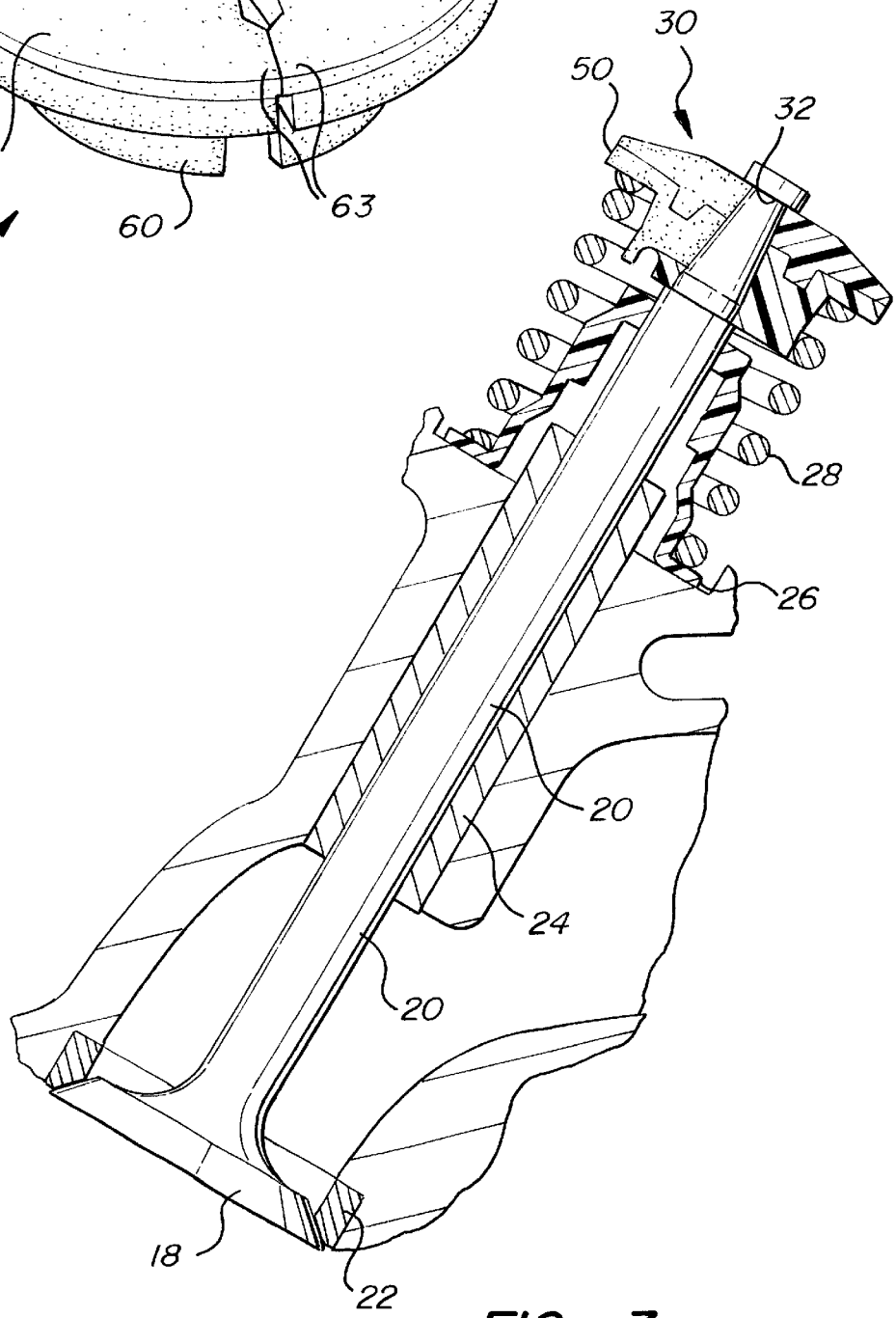
FIG. 3 is an enlarged fragmentary and cross sectional view of one valve assembly illustrated in FIG. 1.
Figure 5:
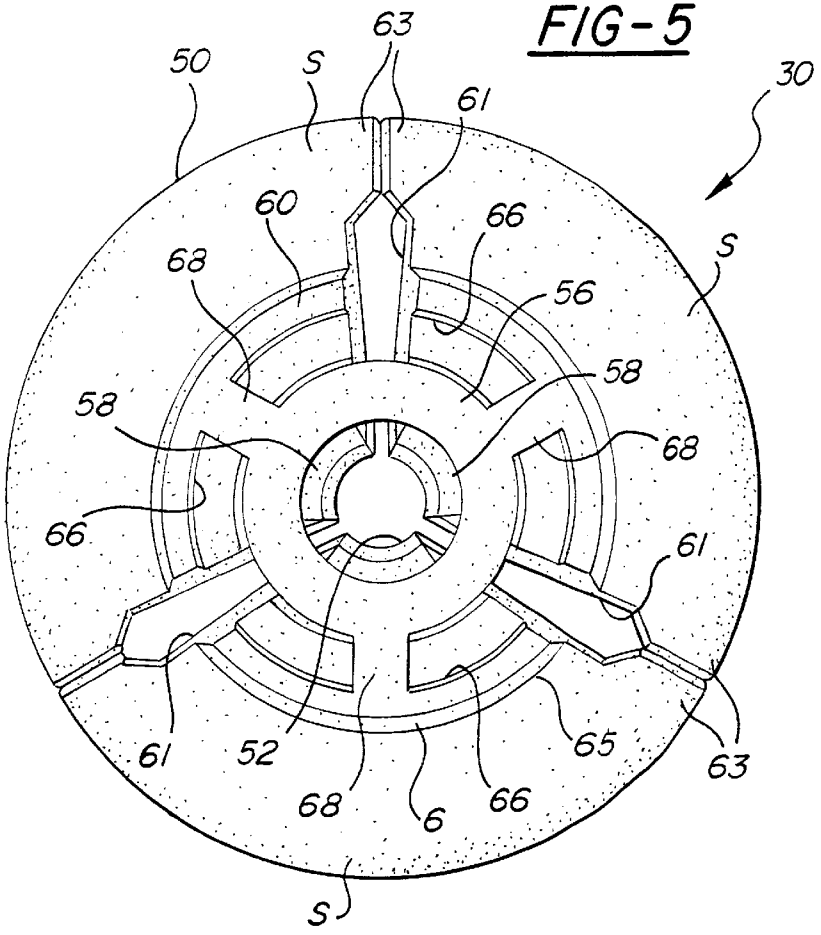
FIG. 5 is a bottom view of the retainer of FIG. 2.
Figure 4:
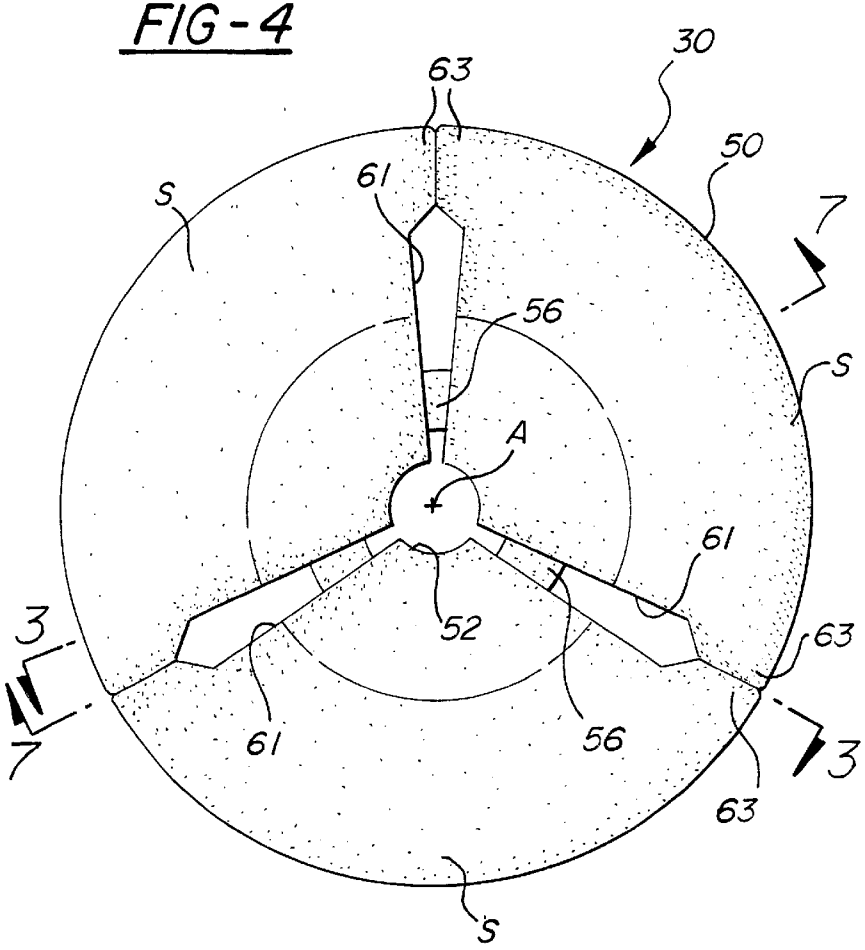
FIG. 4 is a top view of the retainer of FIG. 2 in the operating position.

Referring to the figures, wherein like numerals indicate like or corresponding parts throughout the several views, a head in a typical internal combustion engine is shown in FIG. 1. The cylinder head includes intake ports 12 extending into a combustion chamber 14. A pair of intake valves, generally indicated at 16, each include a valve head and a valve stem 20. The valve heads engage the valve seats 22 and the valve stem 20 is slidably supported in a valve guide 24, which is retained in the cylinder head by a press fit. A plastic seal 26 covers the upper end of the valve guide 24 and engages the stem 20 in a boot-like manner for wiping oil from the valve stem 20. A return spring 28 is disposed concentrically about the valve stem 20 and extends axially from the bottom flange on the seal 26 to a self locking spring retainer constructed in accordance with the subject invention and generally shown at 30.

The valve stem 20 extends above the retainer 30 and engages a rocker arm 34 and includes a recess or undercut 32. The rocker arm engages a hydraulic adjustor 36 and is rotated by a lobe 38 on a cam shaft 40. As the lobe 38 rotates away from the rocker arm 34, the return spring 28 acts against the retainer 30 to urge the retainer 30 into locking engagement with the undercut or recess 32 in the valve stem 20, which, in turn, urges the valve head 18 into sealing engagement with the valve seat 22, all of which is well known in the prior art. The valve spring retainer 30 operatively retains the return spring 28 on the stem 20 of the poppet valve 16.

The retainer 30 is an integral member comprising a retainer flange 50 extending annularly about a hole 52 on a central axis A for engaging the top of the spring 28. The hole 52 is tapered or is conical, having a larger diameter adjacent the bottom and a smaller diameter adjacent the top. The hole 52 engages a taper below the undercut or recess 32 in the valve stem 20.

The retainer 30 is molded of two different plastic materials which bond together and include a plurality of lugs 54 which mechanically interconnect the two materials, which is described in the aforementioned U.S. Pat. No. 5,255,640.

A ring 56 is disposed below the flange 50 and extends about the axis A for surrounding the valve stem 20. An inner portion 58 extends cylindrically about the axis A and axially between the ring 56 and the flange 50. A skirt portion 60 is spaced radially from and extends cylindrically about the inner portion 58 and depends axially from a root diameter R adjacent the flange 50 to a distal end diameter D. A plurality of slots 61 extend radially from the hole 52 and divide the flange 50 and the portions 58 and 60 into sectors S leaving the ring 56 to interconnect the sectors S. The slots 61 extend radially at a wide width and narrow to a limit projection 63 at the periphery of each of the sectors S to define a narrow width whereby the limit projections 63 limit relative annular rotation between the sectors S.

The retainer 30 includes a skirt portion 60 having a waist diameter W and first and second annular extending surfaces 62 and 64 respectively extending axially in opposite directions from the waist diameter W at an included waist angle Θ of less than 180° relative to one another as the skirt portion 60 is viewed in cross section. In other words, the annular surface 62 extends axially between the waist diameter W and the distal end diameter D and the annular surface 64 extends axially between the waist diameter W and the root diameter R. Furthermore, the root diameter R is larger than the waist diameter W. The root diameter R is also larger than the distal end diameter D, but the distal end diameter D is larger than the waist diameter W. The first surface 62 is frusto-conical to increase in diameter from the waist diameter W to the root diameter R and the second surface 64 is frusto-conical to increase in diameter from the waist diameter W to the distal end diameter D. The distal end diameter D is disposed at a beveled surface 65 which extends to the end surface of the skirt 60.

The distal end diameter D and the ring 56 are radially aligned, i.e., aligned horizontally as best viewed in FIG. 7. The skirt portion 60 is spaced radially from the ring 56 to define a void or recess 66 therebetween. A spoke 68 extends radially between the ring 56 and the skirt portion 60 in each of the sectors S, of which there are three, each sector extending annularly through 120°.

The valve stem 20 extends through the ring 56 and the hole 52 in the flange 50 and a spring 28 surrounds the stem 20 and engages the flange 50 in the axial direction and the skirt portion 60 in the radial direction. The spring 28 includes a plurality of convolutions defining an inner diameter and the distal end diameter D is larger than the inner diameter of the spring 28 to form an interference fit.

Figure 9:
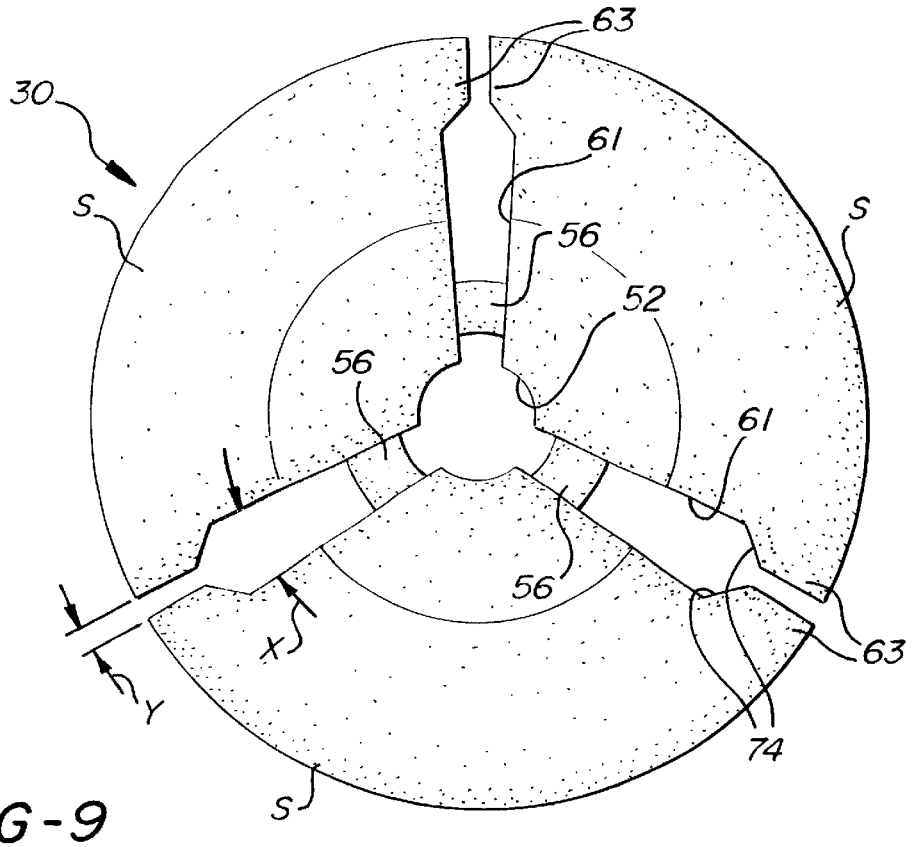
FIG. 9 is a top view of the retainer in the position illustrated in FIG. 8.

The retainer 30 is characterized by the slots 61 extending radially at a wide width x and each sector S including a limit projection 63 at the periphery to define a narrow width y whereby the limit projections 63 limit relative annular rotation between the sectors S (FIG. 9). In other words, during operation, the limit projections 63 hold the sectors S in their respective annular positions so that the dome of the retainer 30 is forced inwardly to force the top of the hole 52 into gripping engagement with the undercut 32 in the valve stem 20.

Figure 10:
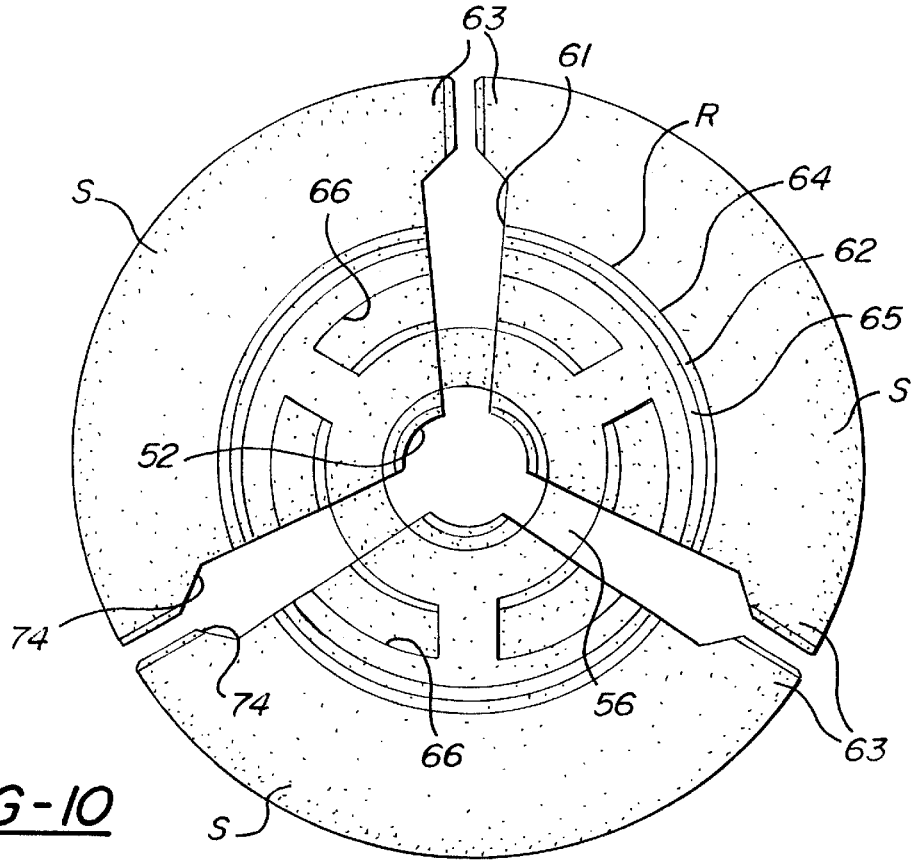
FIG. 10 is a bottom view of the retainer in the position illustrated in FIG. 8.

Each sector S extends annularly between slot edges with each slot edge being spaced from the slot edge of the adjacent sector S to define the wide width x. Each limit projection 63 extends annularly outwardly of the slot edges to limit the movement of adjacent slot edges toward one another. The flange 50 presents an upper surface 70 and a lower surface 72 for engaging the spring 28 and the limit projections 63 extend axially between the surfaces 70 and 72 of the flange 50. A ramp surface 74 (FIGS. 9 & 10) extends between each slot edge and the adjacent limit projection 63 and the ramp surface 74 extends at a sloping angle relative to a radial from the center axis A.

The invention also includes a method of fabricating the valve spring retainer 30 wherein the method includes the steps of forming the slots 61 extending radially at a wide width x, and characterized by forming a limit projection 63 at the periphery of each of the sectors S to define a narrow width y which more narrow than the wide width x. This is accomplished in a mold wherein the retainer 30 is in the forming position shown in FIGS. 8–12. The method may be further defined as molding the slots 61 with a space between the projections 63 which is larger than the operating space to facilitate the removal of the retainer 30 from the molding fixture while allowing the projections 63 to limit rotation of the sectors S toward one another in the operating position. In other words, the retainer 30 is molded in an open or expanded position and collapses to narrow the slots 61 in the operating position but wherein the projections 63 limit that collapsing movement. The retainer 30 may be molded with wide slots 61 to facilitate the molding operation yet the projections 63 limit the movement of the sectors S together while in the operating position shown in FIGS. 1–7.

Also included are the steps of molding the skirt 60 about the ring 56 with the root diameter R being larger than the waist diameter W and the waist diameter W at least as large as the distal end diameter D, as shown in full lines in FIG. 12. When the sectors S are moved together in the operating position, the waist diameter W becomes smaller than both the root diameter R and the distal end diameter D, but the distal end diameter D is larger than the waist diameter W, as shown in phantom lines in FIG. 12. In the forming position, the first surface 62 is frusto-conical to increase in diameter from the waist diameter W to the root diameter R whereas the second surface 64 is cylindrical to maintain a constant diameter from the waist diameter W to the distal end diameter D.

A further step includes forming the retainer 30 of first and second organic polymeric materials with a lug 54 of one material extending into the other material and with one interface of lug 54 between the first and second materials extending axially as the retainer is being formed (solid lines in FIG. 12) whereby the interface is disposed at a mechanical interlocking angle in the operating position (phantom lines in FIG. 12).

The invention has been described in an illustrative manner, and it is to be understood that the terminology which has been used is intended to be in the nature of words of description rather than of limitation.

Obviously, many modifications and variations of the present invention are possible in light of the above teachings and the invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth an old and well known combination in which the invention resides and these antecedent recitations should be interpreted to cover any combination in which the inventive novelty has utility. In addition, the reference numerals are merely for convenience and are not to be in any way to be read as limiting.

What is claimed is:

1. A valve spring retainer (30) for operatively retaining a return spring (28) on a stem (20) of a poppet valve in an internal combustion engine, said retainer (30) comprising;

a retainer flange (50) extending annularly about and radially from a hole (52) on a central axis (A) to an outer periphery for engaging the top of a spring (28), a ring (56) disposed below said flange (50) and extending about said axis (A) for surrounding a valve stem (20), an inner portion (58) extending cylindrically about said axis (A) and axially between said ring (56) and said flange (50), and a plurality of slots (61) extending radially from said hole (52) completely through said periphery and dividing said flange (50) and said inner portion (58) into independent sectors (S) interconnected only by said ring (56), said retainer (30) characterized by said slots (61) extending radially at a wide width (X) and each of said sectors (S) including a limit projection (63) disposed radially outwardly of said wide width (X) and at said periphery to define a narrow width y whereby said limit projections (63) limit relative annular rotation between said sectors (S).

2. A valve spring retainer (30) for operatively retaining a return spring (28) on a stem (20) of a poppet valve in an internal combustion engine, said retainer (30) comprising;

a retainer flange (50) extending annularly about and radially from a hole (52) on a central axis (A) to an outer periphery for engaging the top of a spring (28), a ring (56) disposed below said flange (50) and extending about said axis (A) for surrounding a valve stem (20), an inner portion (58) extending cylindrically about said axis (A) and axially between said ring (56) and said flange (50), and a plurality of slots (61) extending radially from said hole (52) to said periphery and dividing said flange (50) and said inner portion (58) into sectors (S) leaving said ring (56) to interconnect said sectors (S), said retainer (30) characterized by said slots (61) extending radially at a wide width (X) and each of said sectors (S) including a limit projection (63) at said periphery to define a narrow width y whereby said limit projections (63) limit relative annular rotation between said sectors (S) wherein each of said sectors (S) extending annularly between slot edges with each slot edge being spaced from said slot edge of the adjacent sector to define said wide width x, and each of said limit projections (63) extending annularly outwardly of said slot edges to limit the movement of adjacent slot edges toward one another.

3. An assembly as set forth in claim 2 wherein said flange (50) presents an upper surface (70) and a lower surface (72) for engaging the spring (28), and said limit projections (63) extending axially between said surfaces (70 and 72) of said flange (50).

4. An assembly as set forth in claim 3 including a ramp surface (74) extending between each slot edge and the adjacent limit projection (63), said ramp surface (74) extending at a sloping angle relative to a radial from said axis (A).

5. A method of fabricating a valve spring retainer (30) which includes a retainer flange (50) extending annularly about and radially from a hole (52) on a central axis (A) to an outer periphery for retaining a return spring (28) on a stem (20) of a poppet valve in an internal combustion engine with a ring (56) disposed below the flange (50) and extending about the axis (A) for surrounding the valve stem (20), an inner portion (58) extending cylindrically about the axis (A) and axially between the ring (56) and the flange (50), and a plurality of slots (61) extending radially from the hole (52) completely through the periphery and dividing the flange (50) and the inner portion (58) into independent sectors (S) interconnected only by the ring (56), said method comprising the steps of;

forming the slots (61) extending radially at a wide width (X), said method characterized by forming a limit projection (63) disposed radially outwardly of said wide width (X) at said periphery of each of the sectors (S) to define a narrow width (Y) which is more narrow than the wide width (X).

6. A method as set forth in claim 5 including step of forming the retainer (30) of first and second organic polymeric materials with a lug (54) of one material extending into the other material and with one interface of lug (54) between the first and second materials extending axially as the retainer is being formed whereby the interface is disposed at a mechanical interlocking angle in the operating position.

7. A method of fabricating a valve spring retainer (30) which includes a retainer flange (50) extending annularly about and radially from a hole (52) on a central axis (A) to an outer periphery for retaining a return spring (28) on a stem (20) of a poppet valve in an internal combustion engine with a ring (56) disposed below the flange (50) and extending about the axis (A) for surrounding the valve stem (20), an inner portion (58) extending cylindrically about the axis (A) and axially between the ring (56) and the flange (50), and a plurality of slots (61) extending radially from the hole (52) to the periphery and dividing the flange (50) and the inner portion (58) into sectors (S) leaving the ring (56) to interconnect the sectors (S), said method comprising the steps of;

forming the slots (61) extending radially at a wide width (X), said method characterized by forming a limit projection (63) at said periphery of each of the sectors (S) to define a narrow width (Y) which is more narrow than the wide width (X), molding the slots with a space between the projections (63) which is larger than the operating space to facilitate the removal of the retainer (30) from the molding fixture while allowing the projections (63) to limit rotation of the sectors (S) toward one another in the operating position.

8. A method as set forth in claim 6 including the steps of molding a skirt (60) about the ring (56) having a waist diameter (W) and first and second annular extending surfaces (62 and 64) respectively extending axially in opposite directions from the waist diameter (W) at an included waist angle Θ of less than 180° relative to one another as the skirt portion (60) is viewed in cross section with the annular surface (62) extending axially between the waist diameter (W) and a distal end diameter (D) and the annular surface (64) extending axially between the waist diameter (W) and a root diameter (R) and with the root diameter (R) being larger than the waist diameter (W) and the waist diameter (W) being at least as large as the distal end diameter (D) whereby the sectors are moved together in the operating position and the waist diameter (W) becomes smaller than both the root diameter (R) and the distal end diameter (D).

* * * * *